US007131429B2

(12) United States Patent
Dietl et al.

(10) Patent No.: US 7,131,429 B2
(45) Date of Patent: Nov. 7, 2006

(54) METHOD FOR CONTROLLING AN INJECTION VALVE OF AN INTERNAL COMBUSTION ENGINE

(75) Inventors: Roland Dietl, Straubing (DE); Hans-Peter Rabl, Kelheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/053,996

(22) Filed: Feb. 9, 2005

(65) Prior Publication Data

US 2005/0199221 A1 Sep. 15, 2005

(30) Foreign Application Priority Data

Feb. 9, 2004 (DE) ..... 10 2004 006 297

(51) Int. Cl.
*F02M 51/00* (2006.01)

(52) U.S. Cl. ..... 123/490; 123/491; 361/152; 361/154

(58) Field of Classification Search ..... 123/490, 123/491; 361/152, 154
See application file for complete search history.

(56) References Cited

U.S. PATENT DOCUMENTS 4,148,090 A * 4/1979 Kawai et al. ..... 361/152
5,053,911 A * 10/1991 Kopec et al. ..... 361/154
5,947,090 A * 9/1999 Maeda ..... 123/490
6,102,008 A * 8/2000 Maeda et al. ..... 123/490

FOREIGN PATENT DOCUMENTS

| | | |
|---|---|---|
| DE | 101 63 894 A1 | 7/2003 |
| DE | 102 06 906 C1 | 11/2003 |
| DE | 102 33 778 A1 | 2/2004 |
| WO | 03/081007 A1 | 10/2003 |

* cited by examiner

*Primary Examiner*—Erick R Solis
(74) *Attorney, Agent, or Firm*—Laurence A. Greenberg; Werner H. Stemer; Ralph E. Locher

(57) ABSTRACT

A method for controlling an injection valve of an internal combustion engine, in particular a piezo-injector during the start-up phase of the internal combustion engine, in particular a common-rail direct-injection engine. The crankshaft of the internal combustion engine is rotated by the starting motor, in particular an electric starting motor. Next, the actuator of the injection valve has an activation signal applied to it such that when maximum needle lift of the actuator is reached, the activation signal is changed. This change of the activation signal is then evaluated.

17 Claims, 2 Drawing Sheets

METHOD FOR CONTROLLING AN INJECTION VALVE OF AN INTERNAL COMBUSTION ENGINE

BACKGROUND OF THE INVENTION

Field of the Invention

The invention relates to a method for controlling an injection valve of an internal combustion engine, in particular a piezo-injector, during the startup phase of the internal combustion engine, in particular a common-rail direct-injection engine.

Due to manufacturing tolerances, the injection quantities of injectors differ where the same amount of energy is applied. Only at maximum needle lift do the injectors deliver the same injection quantity into the combustion chamber (rail pressure is constant, injection duration is constant). An injector thereby generates a stop signal at maximum needle lift. The signal can be used to determine the energy necessary for the respective injector to achieve the maximum needle lift. It is possible by this means to harmonize the injectors with one another so that for a given activation period and a given injection pressure each injector of an internal combustion engine delivers the same injection quantity.

It is precisely in the harmonization of injectors by means of needle-stop detection that stationary operating points have given a defined activation duration to be present for several seconds depending on the injection pressure. Thereafter, the determined actuator energy of the individual injectors can be assigned to the set of injection parameters and stored. In order, for example, to be able to evaluate the needle-stop signal with certainty, the injector has to be activated for a minimum activation period and a minimum injection pressure. This means that a few milligrams of fuel will already have been injected or that the engine is already running at average partial load. This presents a problem both at the no-load point and in the lower partial-load range, as well as when the system is initially started up.

SUMMARY OF THE INVENTION

It is accordingly an object of the invention to provide a method of regulating or controlling an injection valve of an internal combustion engine which overcomes the above-mentioned disadvantages of the heretofore-known devices and methods of this general type and which will enable harmonization of the injectors during the startup phase of the internal combustion engine.

With the foregoing and other objects in view there is provided, in accordance with the invention, a method of controlling an injection valve of an internal combustion engine, during a start-up phase of the internal combustion engine, which comprises the following steps:

a) turning a crankshaft of the internal combustion engine with a starting motor;

b) applying an activation signal to an actuator of the injection valve, wherein, when a maximum needle lift of the actuator is reached, the activation signal is subject to change; and c) evaluating the change in the activation signal.

The method according to the invention can for example detect the needle stop of an internal combustion engine actuator during the startup phase of the internal combustion engine. Here, the crankshaft of the internal combustion engine is rotated by the starting motor (electric starting motor). The actuator has an activation signal applied to it such that when the maximum needle lift of the actuator is reached, the activation signal is changed. This is detectable in that the voltage applied to the actuator (injector) falls by between one and several volts. This change in the activation signal is then evaluated.

In accordance with an advantageous feature of the invention the rotational speed of the starting motor is kept constant. It is also advantageous to set the start of injection by the actuators such that the internal combustion engine does not start up. This can be achieved for example by the start of injection commencing late. Furthermore, it is advantageous to keep the activation duration constant during the harmonization procedure. This is particularly advantageous since offsetting of the differences in injection quantities between the individual injectors is carried out under defined stationary operating points which are seldom reached when traveling, in particular prior to initial startup of the system.

A further advantageous embodiment of the invention is to store the defined actuator energy together with the relevant injection parameters, and then to change the injection pressure by a defined amount, i.e. for example to increase the injection pressure by 100 bar. According to the invention, the stroke energy needed for each actuator to achieve the maximum needle lift is determined for this new injection pressure. These steps are repeated until such time as the injection pressure has reached a peak value. In this case, this could for example be a maximum pressure of 1500 bar. This is particularly advantageous since calibration of the injection quantity to the relevant injection parameters can be achieved. Other features which are considered as characteristic for the invention are set forth in the appended claims.

Although the invention is illustrated and described herein as embodied in a method for controlling an injection valve of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
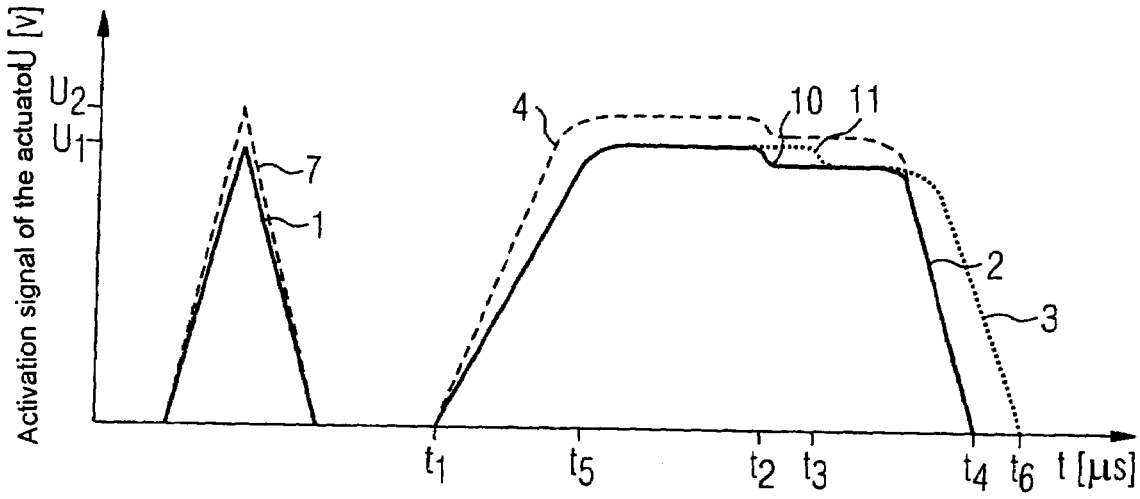
FIG. 1 is a graph with the temporal course of the activation signals fed to two injectors.

Referring now to the figures of the drawing in detail and first, particularly, to FIG. 1 thereof, there is shown a temporal course of three activation signals. Firstly, only the solid-line curves 1 and 2 of a first injector (actuator) will be examined. The curve 1 of a triangular signal, the maximum value of which is labeled $U_1$, causes a pilot injection. After a certain time, the main injection begins at time $t_1$ and lasts until time $t_4$. This main injection curve 2 has a duration of approx. 600 μsec. That is the difference between time $t_4$ and time tl. As already mentioned above, the voltage is applied at time $t_1$, and the maximum voltage $U_1$ (e.g. 100 V) is applied at time $t_5$. During this period the needle is lifted until it has reached its maximum lift at time $t_2$. As a consequence of this, the voltage falls by a few volts, which can be seen in a change 10 in curve 2. The activation signal of the first actuator is taken as a reference for the signals of the other actuators. The time $t_2$ is thus deemed to be ideal.

If the activation signal of a second actuator (injector) which is operated with the same maximum voltage $U_1$ is examined, then it can happen that due to manufacturing tolerances the maximum stroke takes place for example at the non-ideal time $t_3$, i.e. later than in the case of the first actuator. The activation curve of the second actuator is labeled 3 and shown as a dotted line. As previously mentioned, the voltage dip occurs at time $t_3$ and is labeled by the reference symbol 11. Since the engine control of the internal combustion engine is triggered on the stop signal, the second actuator is not deactivated until time $t_6$. The consequence of this is that the injection quantity emitted by this second actuator is higher.

In order to prevent this, the maximum voltage applied to the second injector is changed by way of the method according to the invention such that the voltage dip occurs at the ideal time. This is shown by the curve 4 shown as a dashed line. The second actuator requires a maximum voltage $U_2$ (e.g., 135 V) in order to achieve a voltage dip, i.e. for the needle to reach its maximum lift, at the same ideal time $t_2$. As can be seen in FIG. 1, by increasing the maximum voltage to $U_2$ the curve 3 changes into curve 4, with the break 11 occurring earlier and the amplitude being increased correspondingly. The consequence of this is that the relevant pilot injection 7, shown as a dashed line, also has a higher voltage amplitude.

Figure 2:
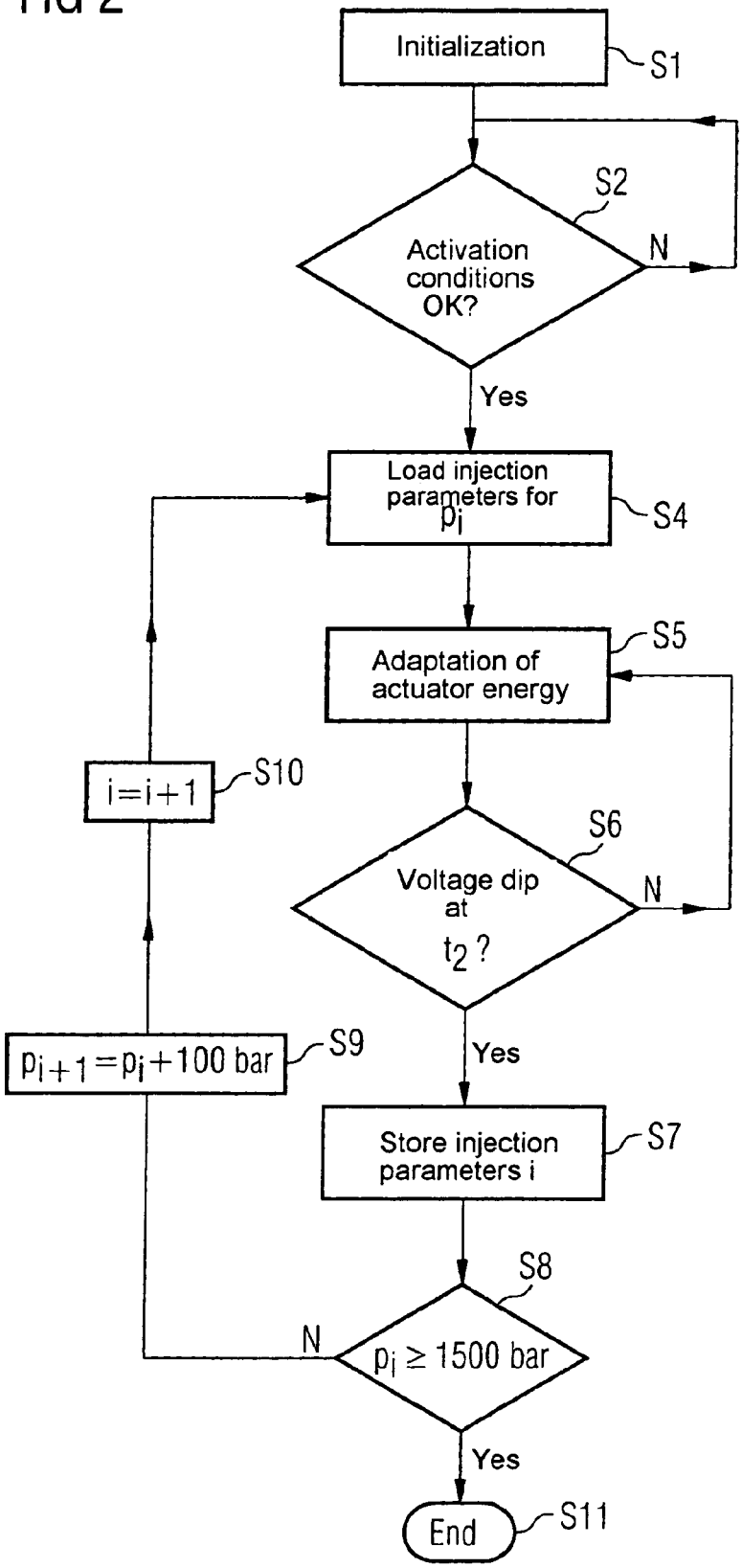
FIG. 2 is a flow diagram for determining the actuator energy for various injection parameters according to the invention.

An exemplary embodiment of the method according to the invention is represented in FIG. 2. Initialization occurs upon engine startup, that is the crankshaft of the engine is driven by the electric starting motor, in step S1. Step S2 involves waiting until predetermined activation conditions are fulfilled. These activation conditions include constant injection pressure, fixed injection start and constant engine speed. As soon as such a defined stationary operating point applies, the injection parameters for a defined injection pressure $p_i$ are loaded in step S4. The initial pressure $p_1$ lies for example at 400 bar. The high-pressure pump needs approx. 1 second in order to build up this pressure. Next, in step S5 the actuator energy is adapted cylinder-selectively. Thus, a voltage of for example 130 V is applied and it is examined when the voltage dip 10 or 11 occurs. If the voltage dip lies before or after $t_2$, the actuator energy has to be adapted accordingly. If the voltage dip takes place at the correct ideal time $t_2$, then the process goes on to step S7. There, the relevant injection parameters i are stored. As mentioned above, the initial pressure $P_1$ lies at 400 bar. The injection pressure pi is checked in step S8. If it lies below a maximum pressure of for example 1500 bar, the process skips to step S9. There, the pressure being applied is increased by for example 100 bar. In step S10 only the index is increased by 1, the relevant parameters P2 then being loaded in step S4. Now an injection pressure of 500 bar is applied. Steps S5 to S8 are then run through accordingly. This is repeated until such time as the injection pressure has been increased up to the maximum pressure of for example 1500 bar. By this means, the actuator energy of the individual injectors will have been adapted for the various injection pressures. After calibration, which lasts for approximately 3 to 4 seconds, has occurred, the starting up of the engine can begin. As soon as the fuel injected into the combustion chamber of the engine has itself ignited, activation of the electric starting motor can be terminated.

It is particularly advantageous that adaptation of the injection quantity, in particular upon initial startup of the operating system, can be carried out without the need for additional sensor technology. A further advantage of the method according to the invention is to optimize the injection parameters and the actuator energy for cold starts. Particularly where outside temperatures are down to −30° C., the method according to the invention is highly advantageous since the viscosity of the fuel rises and the energy needed for activating the injector is also different from that at a normal temperature of approx. 25° C.

This application claims the priority, under 35 U.S.C. § 119, of German patent application No. 10 2004 006 297.8, filed Feb. 9, 2004; the entire disclosure of the prior application is herewith incorporated by reference.

We claim:

1. A method of controlling an injection valve of an internal combustion engine, during a start-up phase of the internal combustion engine, which comprises the following steps:

a) turning a crankshaft of the internal combustion engine with a starting motor;

b) applying an activation signal to an actuator of the injection valve, wherein, when a maximum needle lift of the actuator is reached, the activation signal is subject to change; and c) evaluating the change in the activation signal and adjusting at least one parameter for a further actuator in response to the evaluation; and d) while continuing the turning of the crankshaft with the starting motor, applying an activation signal to the further actuator.

2. The method according to claim 1, which comprises executing step b) only after a rotational speed of the starting motor in step a) is constant.

3. The method according to claim 1, wherein the change in the activation signal is a drop in a voltage of the activation signal.

4. The method according to claim 1, wherein a quantity of fuel injected by the actuator amounts to at least 20 mg per piston stroke of the internal combustion engine.

5. The method according to claim 1, wherein the evaluating step comprises determining a time at which a needle of the actuator has reached maximum needle lift.

6. The method according to claim 5, which further comprises, subsequently to step c), adapting an energy of the activation signal if a time for reaching the maximum needle lift deviates from an ideal time.

7. The method according to claim 6, wherein the adapting step comprises raising the voltage of the activation signal proportionally If the time for reaching the maximum needle lift occurs after the ideal time or lowering the voltage of the activation signal if the time for reaching the maximum needle lift occurs before the ideal time.

8. The method according to claim 7, wherein the internal combustion engine has a plurality of actuators, and which comprises determining the respective time for reaching the maximum needle lift for each actuator and adapting a voltage of the activation signals of each of the actuators such that the voltage drop in the activation signal for each actuator occurs at the ideal time.

9. The method according to claim 1, wherein the internal combustion engine has a plurality of actuators, and which comprises determining the respective time for reaching the maximum needle lift for each actuator and adapting an energy of the activation signals of all the actuators such that the change in the activation signal for each actuator occurs at an ideal time.

10. The method according to claim 8, wherein the adapting step is followed by a step of determining and storing the energy necessary for each actuator to achieve the maximum needle lift at the ideal time.

11. The method according to claim 10, wherein the determining and storing step is followed by a step of changing an injection pressure of the actuator by a defined amount.

12. The meThod according to claim 11, wherein the steps of applying, evaluating, adapting, and determining and storing steps are repeated in order until such time as the injection pressure has reached a peak value.

13. The method according to claim 1, which comprises setting an injection start of the actuators such that the internal combustion engine does not start running.

14. The method according to claim 1, wherein the injection valve is a piezo-injector.

15. A method of controlling an injection valve of an internal combustion engine, during a start-up phase of the internal combustion engine, which comprises the following steps:

a) turning a crankshaft of the internal combustion engine with a starting motor;

b) applying a first activation signal to an actuator of a first injection valve, wherein, when a maximum needle lift is reached, the activation signal is subject to change, and recording a time from first applying the activation signal to reaching maximum needle lift, as indicated by the change in the activation signal, as a first time period; and c) applying a second activation signal to an actuator of a second injection valve and adjusting an Intensity of the second activation signal such that the actuator of the second injection valve reaches a maximum needle lift within a second time period corresponding to the first time period.

16. The method according to claim 15, wherein the activation signal is a voltage and the adjusting step comprises: increasing the voltage for actuating the second injection valve in order to shorten the second time period or decreasing the voltage for actuating the second injection valve in order to lengthen the second time period.

17. The method according to claim 15, which comprises characterizing the first time period as an ideal time period and adjusting the actuators of all further injection valves of the internal combustion engine until the opening times of all of the injection valve actuators substantially correspond to the first time period.

* * * * *